US007210298B2

(12) United States Patent
Lin

(10) Patent No.: US 7,210,298 B2
(45) Date of Patent: May 1, 2007

(54) ICE CUBE MAKER

(76) Inventor: Ching-Yu Lin, No. 30, Lane 455, Yuehmei Rd., Luodong Chen, Yilan Hsien (TW)

( * ) Notice: Subject to any disclaimer, the term of this patent is extended or adjusted under 35 U.S.C. 154(b) by 182 days.

(21) Appl. No.: 11/131,183

(22) Filed: May 18, 2005

(65) Prior Publication Data

US 2006/0260325 A1 Nov. 23, 2006

(51) Int. Cl.
*F21B 21/02* (2006.01)

(52) U.S. Cl. ..... 62/3.63

(58) Field of Classification Search ..... 62/3.62, 62/3.63, 71–73, 66, 135–139, 233, 340, 351, 62/353

See application file for complete search history.

(56) References Cited

U.S. PATENT DOCUMENTS 2,990,692 A * 7/1961 Hubacker et al. ..... 62/71
3,238,740 A * 3/1966 Ross ..... 62/354
3,308,631 A * 3/1967 Kniffin ..... 62/137
3,327,713 A * 6/1967 Eidus ..... 607/96
3,407,619 A * 10/1968 Walker ..... 62/137
4,835,978 A * 6/1989 Cole ..... 62/137
5,921,103 A * 7/1999 Hilsinger ..... 62/340
5,953,924 A * 9/1999 Li et al. ..... 62/71
6,401,461 B1 * 6/2002 Harrison et al. ..... 62/3.61
6,453,696 B1 * 9/2002 Kawasumi et al. ..... 62/344
6,820,433 B2 * 11/2004 Hwang ..... 62/3.63
6,951,113 B1 * 10/2005 Adamski ..... 62/3.62

FOREIGN PATENT DOCUMENTS

JP 2-93266 A * 4/1990

* cited by examiner

*Primary Examiner*—Mohammad M. Ali
(74) *Attorney, Agent, or Firm*—Birch, Stewart, Kolasch & Birch, LLP

(57) ABSTRACT

An ice cube maker has an upper container, a cooling module assembly mounted to the upper container, a lower container, a water flow controller and an ice module assembly. The upper container acts as a reservoir and holds a liquid. The cooling module assembly is attached to the upper container and chills the liquid in the upper container. The water flow controller is mounted between the upper container and the lower container and controls the chilled liquid entering the lower container. The ice module assembly is attached to the lower container and freezes the chilled liquid into ice cubes in a short time. The ice cube maker allows people who do have a refrigerator to make ice cubes and chilled liquid. The ice cubes and chilled liquid do not have any strange smell.

12 Claims, 3 Drawing Sheets

ICE CUBE MAKER

BACKGROUND OF THE INVENTION

1. Field of the Invention

The present invention relates to an ice cube maker, and more particularly to an ice cube maker that is able to remove heat from a liquid and make ice cubes.

2. Description of Related Art

A conventional refrigerator keeps food fresh and also makes ice cubes. A conventional way to make ice cubes is to put liquid into an ice tray and put the ice tray into the refrigerator freezer. When the liquid freezes, the ice cubes are done. However, the ice cubes may take on a food smell. The smell of the ice cubes may be very terrible.

Furthermore, some people do not have a refrigerator in their apartment or house. For these people, making their own ice cubes is virtually impossible.

The present invention provides an ice cube maker to obviate or mitigate the aforementioned problems.

SUMMARY OF THE INVENTION

The primary objective of the present invention is to provide an improved ice cube maker that allows people to make ice cubes anywhere, and the ice cubes will not take on any strange smell.

The ice cube maker has an upper container, a cooling module assembly, a lower container, a water flow controller and an ice module assembly. The upper container acts as a reservoir and holds a liquid. The cooling module assembly is attached to the upper container and chills the liquid in the upper container. The water flow controller is mounted between the upper container and the lower container and controls the chilled liquid entering the lower container. The ice module assembly is attached to the lower container, and freezes the chilled liquid into ice cubes in a short time. The ice cube maker allows people who do have a refrigerator to make ice cubes and chilled liquid. The ice cubes and chilled liquid do not have any strange smell.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
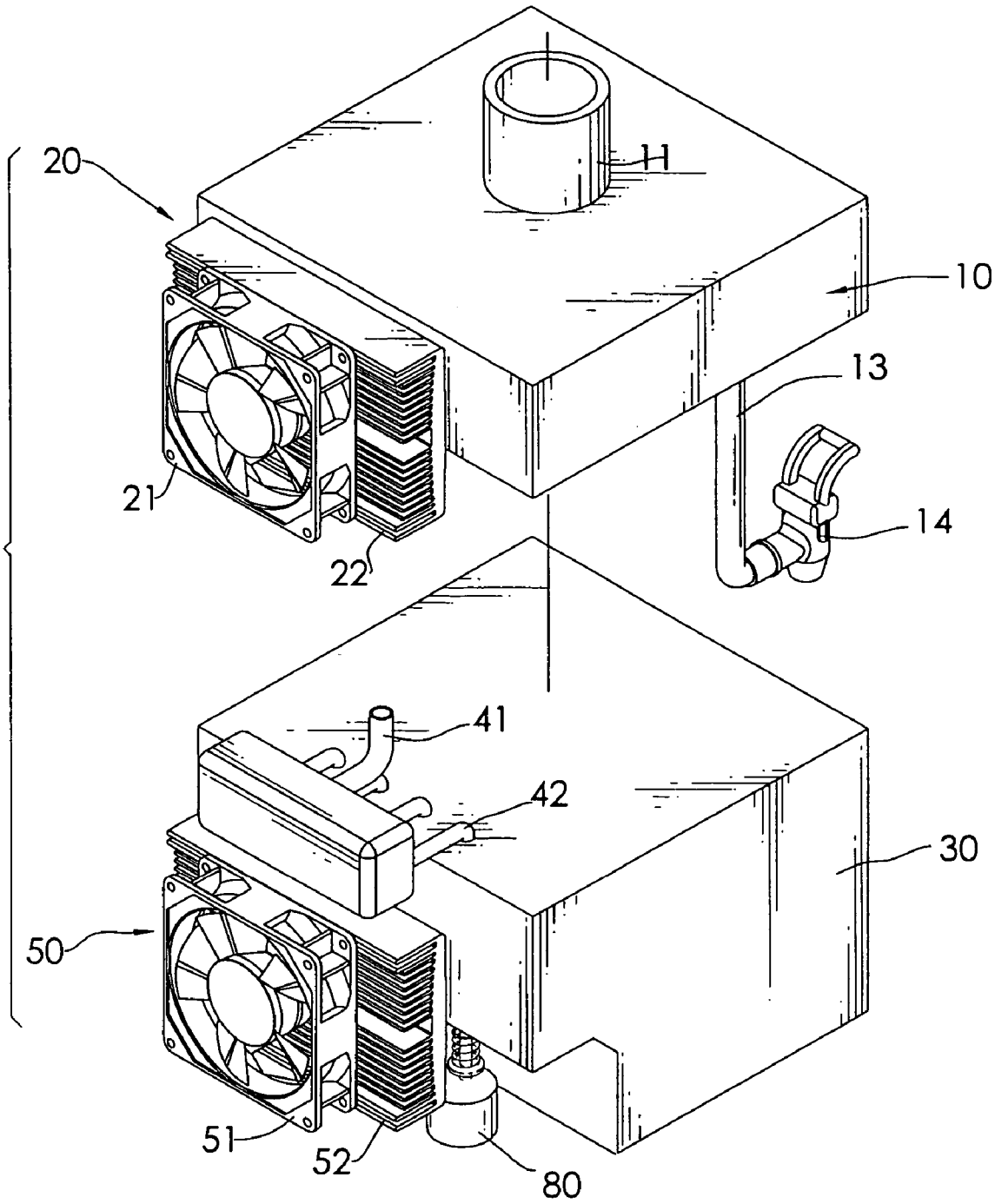
FIG. 1 is an exploded perspective view of an ice cube maker in accordance with the present invention.
Figure 2:
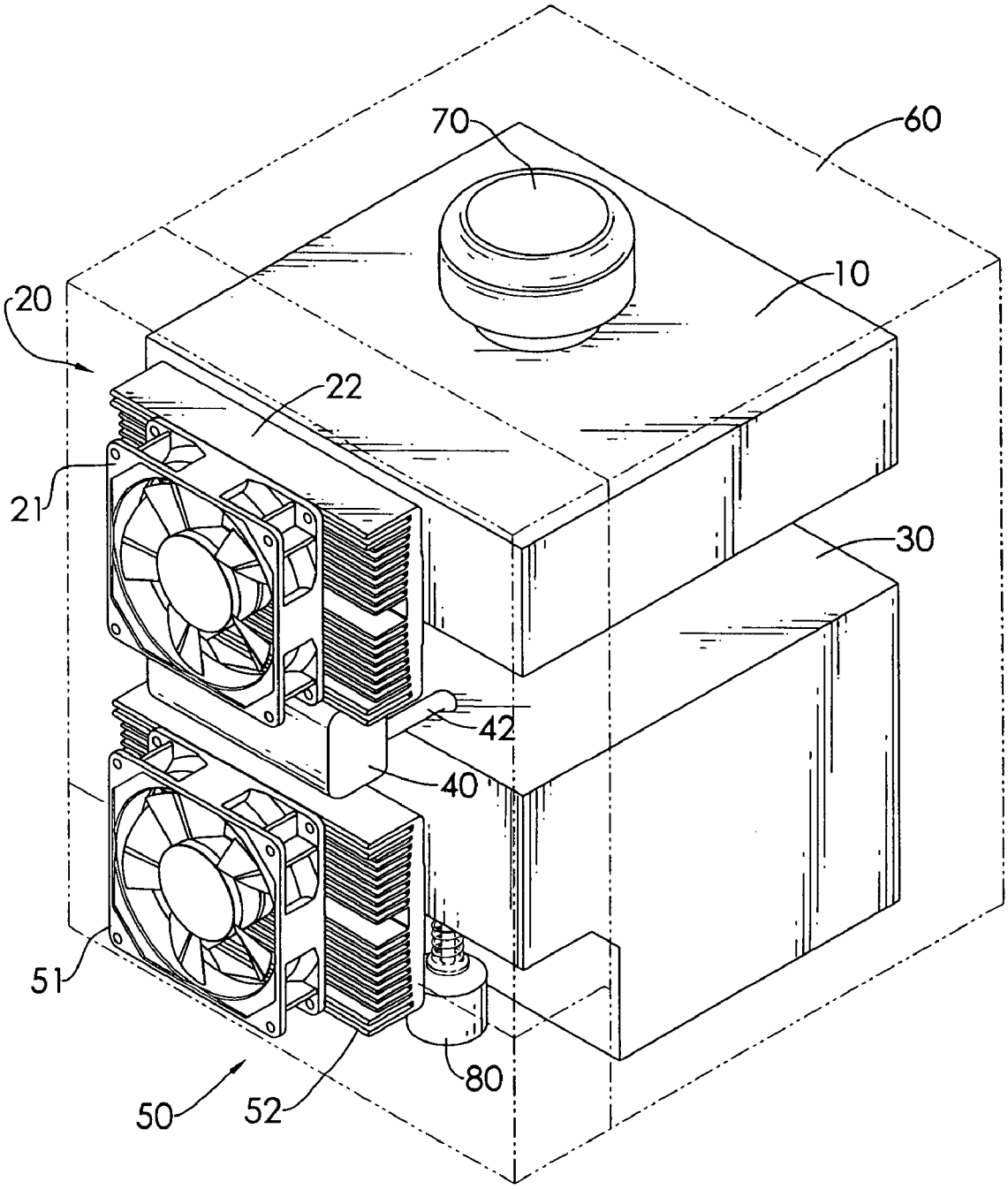
FIG. 2 is a perspective view of the ice cube maker in FIG. 1.
Figure 3:
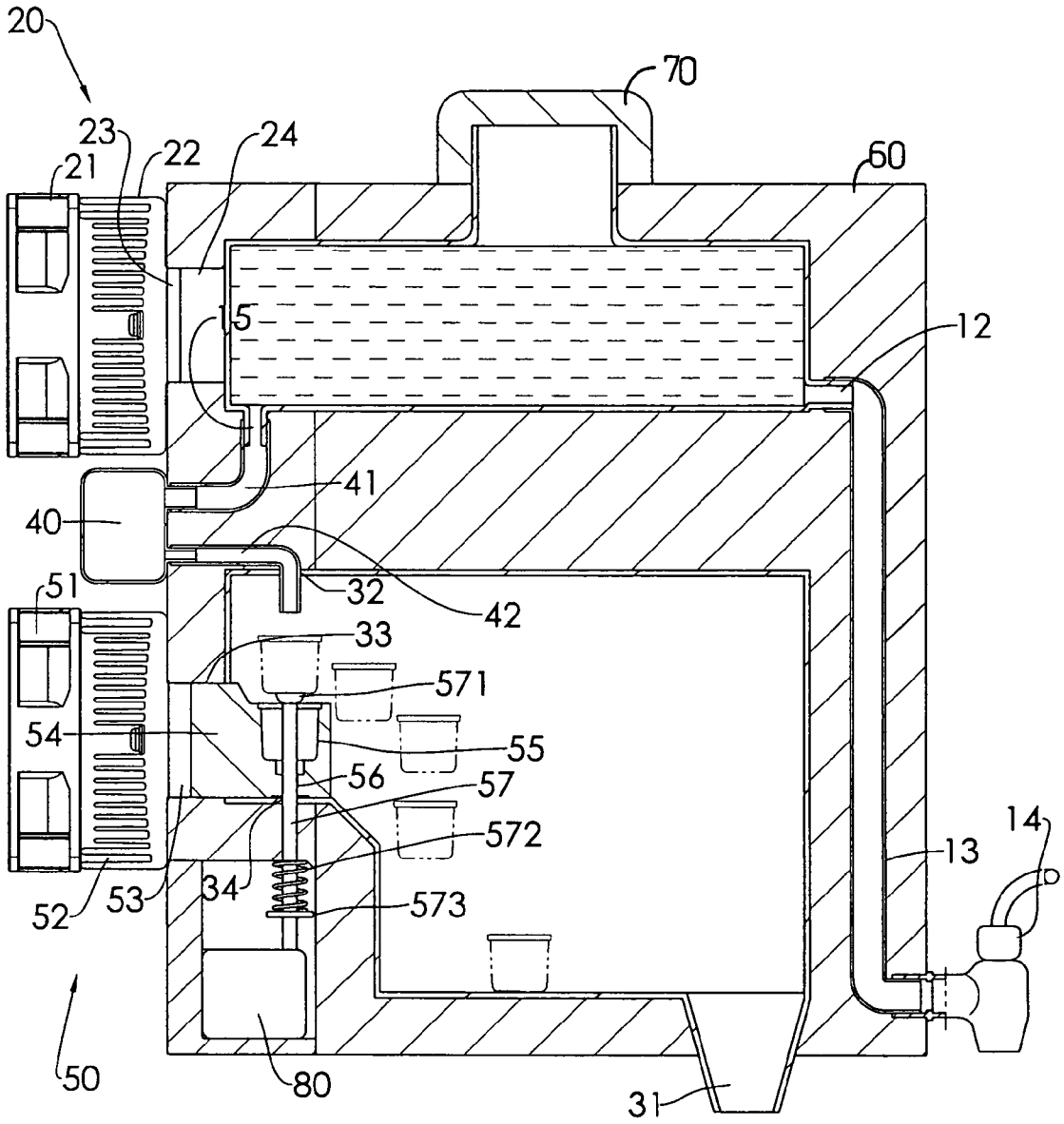
FIG. 3 is a side view in partial section of the ice cube maker in FIG. 1.

With reference to FIGS. 1, 2 and 3, an ice cube maker in accordance with the present invention comprises an upper container (10), a cooling module assembly (20), a lower container (30), a water flow controller (40), an ice module assembly (50), an optional pushing apparatus (80) and an optional insolated case (60).

The upper container (10) has a top, a bottom, a front, a rear surface, a water inlet (11), an optional cap (70), an optional drinking water outlet (12), chilled water outlets (15), an optional drinking water tube (13) and an optional bibcock (14). The bottom has an edge, and the front has an edge. The water inlet (11) is formed in the upper container (10), and liquid is poured into the upper container (10) through the water inlet (11). The cap (70) is mounted removably on the water inlet (11) and selectively closes the water inlet (11). The chilled water outlets (15) are formed at the edge of the bottom. The drinking water outlet (12) is formed at the edge of the front. The drinking water tube (13) has a proximal end and a distal end. The proximal end of the drinking water tube (13) is attached to the drinking water outlet (12). The bibcock (14) is attached to the distal end of the drinking water tube (13) and allows liquid to be dispensed from the upper container (10).

The cooling module assembly (20) is mounted on the rear surface of the upper container (10), chills liquid in the upper container (10) and has a heat conducting block (24), a thermoelectric cooling chip (23), a heat sink (22) and a fan (21). The heat conducting block (24) is mounted against the rear surface of the upper container (10) and has an exterior side. The thermoelectric cooling chip (23) draws heat from liquid in the upper container (10) through the heat conducting block (24), chills the liquid in the upper container (10) and has a cooling side. The cooling side of the thermoelectric cooling chip (23) is mounted against the exterior surface of the heat conducting block (24). The heat sink (22) and the fan (21) are mounted sequentially on the thermoelectric cooling chip (23) and dissipate heat from the thermoelectric cooling chip (23).

The lower container (30) has a top, a bottom, a rear, an ice cube chute (31), inlet ports (32), a rear opening (33) and multiple access holes (34). The top has an edge. The bottom of the lower container (30) has a front edge and a rear edge. The ice cube chute (31) is formed in the bottom near the front edge of the lower container (30). The inlet ports (32) are formed in the top of the lower container (30) and correspond to the chilled water outlets (15) in the upper container (10). The rear opening (33) is formed in the rear of the lower container (30). The access holes (34) are formed in the bottom of the lower container (30) near the rear edge.

The water flow controller (40) may be an electromagnetic valve, is mounted between the upper container (10) and the lower container (30), controls the flow of chilled liquid into the lower container (30) and has inlet tubes (41) and discharge tubes (42). The inlet tubes (41) have proximal ends and distal ends. The proximal ends of the inlet tubes (41) are connected to the water flow controller (40). The distal ends of the inlet tubes (41) are connected to the chilled water outlets (15) in the upper container (10). The discharge tubes (42) have proximal ends and distal ends. The proximal ends of the discharge tubes (42) are connected to the water flow controller (40). The distal ends of the discharge tubes (42) are mounted through the inlet ports (32) in the lower container (30) and extend into the lower container (30).

The ice module assembly (50) is attached to the rear of the lower container (30), quickly freezes chilled liquid dispensed from the water flow controller (40) and has an ice tray (54), a thermoelectric cooling chip (53), a heat sink (52) and a fan (51). The ice tray (54) extends through the rear opening (33) in the lower container (30), holds chilled water dispensed from the water flow controller (40) and has an exterior side, a top surface, multiple recesses (55) and multiple push rods (57). The recesses (55) are formed separately in the top surface of the ice tray (54), correspond respectively to the inlet ports (32) in the lower container (30), may be cone-shaped and hold chilled liquid dispensed from the water flow controller (40). Each recess (55) has a bottom and a through hole (56). The through holes (56) are formed respectively through the bottoms of the recesses (55) and correspond respectively to the access holes (34) in the lower container (30).The push rods (57) are slidably mounted respectively in the through holes (56) in the recesses (55) in the ice tray (54) and the access holes (34) in the lower container (30) and push frozen liquid out of the recesses (55). Each push rod (57) has an inner end, an outer end, a head (571), a flange (573) and a spring (572). The head (571) is attached to the inner end of the pushing rod (57) and abuts the frozen liquid in the recesses (55). The flange (573) is mounted at the outer end of the push rod (57). The spring (572) is mounted around the push rod (57) between the flange (573) and the ice tray (54) and pushes the push rod (57) down after frozen liquid is pushed out of the recesses (55) so the head (571) seats in the bottom of the recess (55).

The thermoelectric cooling chip (53) draws heat from the chilled liquid in the ice tray (54), freezes the chilled liquid quickly and has a cooling surface. The cooling surface of the thermoelectric cooling chip (53) is attached to the exterior side of the ice tray (54) and draws heat from the ice tray (54).

The fan (51) and the heat sink (52) are attached sequentially to the thermoelectric cooling chip (53) and dissipate heat from the thermoelectric cooling chip (53).

The pushing apparatus (80) is mounted below the outer ends of the push rods (57) and selectively pushes the push rods (57).

The insolated case (60) is mounted over the upper container (10), the lower container (30) and the pushing apparatus (80).

Chilling the liquid in the upper container (10) allows the liquid to freeze into the ice cubes in a short time. People are able to dispense ice cubes through the ice cube chute (31) in the lower container (30) and dispense chilled liquid directly from the upper container (10).

In conclusion, the ice cube maker is small enough so people can chill a liquid and make ice cubes anywhere that has a source of power to drive the cooling module assembly (20), the water flow controller (40), the ice module assembly (50) and the pushing apparatus (80). Since the ice cube maker is used only to chill a liquid and make ice cubes, the chilled liquid and ice cubes will not pick up any strange smells.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. An ice cube maker comprises an upper container having
- a top;
- a bottom having an edge;
- a front having an edge;
- a rear surface;
- a water inlet formed in the upper container; and
- multiple chilled water outlets formed at the edge of the bottom of the upper container;

a cooling module assembly mounted on the rear surface of the upper container and having
- a heat conducting block mounted against the rear surface of the upper container and having an exterior side;
- a thermoelectric cooling chip having a cooling side mounted against the exterior side of the heat conducting block;
- a heat sink mounted on the thermoelectric cooling chip; and
- a fan mounted on the heat sink;

a lower container having
- a top having an edge;
- a bottom having
  - a front edge; and
  - a rear edge;
- a rear;
- an ice cube chute formed in the bottom near the front edge of the lower container;
- inlet ports formed in top of the lower container and corresponding to the chilled water outlets of the upper container;
- a rear opening formed in the rear of the lower container; and
- multiple access holes formed in the bottom of the lower container near the rear edge;

a water flow controller mounted between the upper container and the lower container and having
- multiple inlet tubes, each inlet tube having
  - a proximal end connected to the water flow controller; and
  - a distal end connected to one of the chilled water outlets in the upper container; and
- multiple discharge tubes, each discharge tube having
  - a proximal end connected to the water flow controller; and
  - a distal end mounted through one of the inlet ports in the lower container and extending into the lower container; and an ice module assembly attached to the rear of the lower container and having
- an ice tray extending through the rear opening in the lower container and having
  - an exterior side;
  - a top surface;
  - multiple recesses formed separately in the top surface of the ice tray and corresponding respectively to the inlet ports in the lower container, and each recess having
    - a bottom; and
    - a through hole formed through the bottom of the recess and corresponding to one of the access holes in the lower container;
  - multiple push rods slidably mounted respectively in the through holes in the recesses in the ice tray and the access holes in the lower container, and each push rod having
    - an inner end;
    - an outer end;
    - a head attached to the inner end of the push rod;
    - a flange mounted at the outer end of the push rod; and
    - a spring mounted around the push rod between the flange and the ice tray;
- a thermoelectric cooling chip having a cooling side attached to the exterior side of the ice tray;
- a heat sink attached to the thermoelectric cooling chip; and
- a fan attached to the heat sink.

2. The ice cube maker as claimed in claim 1, wherein the upper container further has a drinking water outlet formed at the edge of the front of the upper container;

a drinking water tube having a proximal end attached to the drinking water outlet; and a distal end; and a bibcock attached to the distal end of the drinking water tube.

3. The ice cube maker as claimed in claim 1, wherein the ice cube maker further comprises a pushing apparatus mounted below the outer ends of the push rods and selectively pushing the push rods.

4. The ice cube maker as claimed in claim 2, wherein the ice cube maker further comprises a pushing apparatus mounted below the outer ends of the push rods and selectively pushes the push rods.

5. The ice cube maker as claimed in claim 3, wherein the ice cube maker further has an insolated case mounted over the upper container, the lower container and the pushing apparatus.

6. The ice cube maker as claimed in claim 4, wherein the ice cube maker further has an insolated case mounted over the upper container, the lower container and the pushing apparatus.

7. The ice cube maker as claimed in claim 5, wherein the upper container further has a cap mounted removably on the water inlet and selectively closing the water inlet.

8. The ice cube maker as claimed in claim 6, wherein the upper container further has a cap mounted removably on the water inlet and selectively closing the water inlet of the upper container.

9. The ice cube maker as claimed in claim 7, wherein the water flow controller is an electromagnetic valve.

10. The ice cube maker as claimed in claim 8, wherein the water flow controller is an electromagnetic valve.

11. The ice cube maker as claimed in claim 9, wherein the recesses are cone-shaped.

12. The ice cube maker as claimed in claim 10, wherein the recesses are cone-shaped.

* * * * *